US008058998B2

(12) United States Patent
Burnside et al.

(10) Patent No.: US 8,058,998 B2
(45) Date of Patent: Nov. 15, 2011

(54) ELONGATED TWIN FEED LINE RFID ANTENNA WITH DISTRIBUTED RADIATION PERTURBATIONS

(75) Inventors: Walter D. Burnside, Dublin, OH (US); Robert J. Burkholder, Columbus, OH (US); Feng-Chi Eddie Tsai, Zhubei (TW)

(73) Assignees: Wistron NeWeb Corporation, Taipei Hisen (TW); Ohio State University Research Foundation, Columbus, OH (US)

( * ) Notice: Subject to any disclaimer, the term of this patent is extended or adjusted under 35 U.S.C. 154(b) by 299 days.

(21) Appl. No.: 12/395,748

(22) Filed: Mar. 2, 2009

(65) Prior Publication Data

US 2010/0060457 A1 Mar. 11, 2010

Related U.S. Application Data

(60) Provisional application No. 61/191,687, filed on Sep. 11, 2008.

(51) Int. Cl.
*G08B 13/14* (2006.01)

(52) U.S. Cl. ..... 340/572.7; 340/572.8; 340/426.1; 340/547; 340/561; 340/564; 340/10.1; 340/870.01; 343/744; 343/767; 343/770; 343/795; 343/810; 343/824; 343/846

(58) Field of Classification Search ..... 340/572.7, 340/572.8, 426, 547, 561, 564, 825.31, 870.01; 343/744, 767, 770, 795, 810, 824, 846
See application file for complete search history.

(56) References Cited

U.S. PATENT DOCUMENTS

| | | | | |
|---|---|---|---|---|
| 5,781,867 | A * | 7/1998 | Tidwell | 455/575.7 |
| 5,859,616 | A | 1/1999 | Gans et al. | |
| 6,882,338 | B2 | 4/2005 | Flowers | |
| 7,474,212 | B2 | 1/2009 | Nakagawa et al. | |
| 2004/0032369 | A1 | 2/2004 | Flowers | |
| 2005/0242953 | A1 | 11/2005 | Nakagawa et al. | |
| 2007/0004363 | A1 * | 1/2007 | Kusaka et al. | 455/269 |
| 2007/0273528 | A1 | 11/2007 | Burkholder et al. | |
| 2007/0273529 | A1 | 11/2007 | Lee et al. | |
| 2008/0284654 | A1 | 11/2008 | Burnside et al. | |

FOREIGN PATENT DOCUMENTS

JP 2006-042240 A 2/2006

OTHER PUBLICATIONS

International Search Report dated Dec. 24, 2009 of International Application No. PCT/US2009/043871, filed May 14, 2009.
International Preliminary Report on Patentability, dated Mar. 15, 2011 for corresponding International PCT Application No. PCT/US2009/043871, filed May 14, 2009.

* cited by examiner

*Primary Examiner* — Tai T Nguyen
(74) *Attorney, Agent, or Firm* — Pearne & Gordon LLP

(57) ABSTRACT

An RFID antenna comprising an elongated structure existing along an axis that is long compared to the signal wavelength and including twin ribbon-like feed lines of electrically conductive material, the feed lines being in a common plane and being uniformly laterally spaced from one another, and a plurality of radiating perturbations associated with the feed lines at a plurality of locations spaced along the feed lines, at each location each feed line has its own individual perturbation or portion of a perturbation.

28 Claims, 5 Drawing Sheets

ELONGATED TWIN FEED LINE RFID ANTENNA WITH DISTRIBUTED RADIATION PERTURBATIONS

This application claims the priority of U.S. Provisional Application No. 61/191,687, filed Sep. 11, 2008.

BACKGROUND OF THE INVENTION

The invention pertains to radio frequency identification (RFID) systems and, in particular, to an improved antenna for such applications.

PRIOR ART

RFID technology is expected to greatly improve control over the manufacture, transportation, distribution, inventory, and sale of goods. A goal, apparently not yet realized on a widespread scale, is the identification of goods down to a unit basis at a given site. To accomplish this goal, each item will carry a unique tag that, when it receives radiation from an RFID antenna, will send back a modulated unique signal verifying its presence to the antenna. The antenna, in turn, receives this transmitted signal and communicates with a reader that registers reception of this signal and, therefore, the presence and identity of the subject item.

Typically by its nature, an RFID tag identifying a subject item is polarized so that its response to a radio signal will depend on its alignment with the polarization of the signal radiated by the RFID antenna. Items can be expected to be randomly positioned in the space being surveyed by the RFID system and, therefore, the system should be capable of reading these items. Signal fading due to interference, absorption, reflection and the like can adversely affect the ability of an RFID antenna to reliably read an RFID tag. These conditions make it desirable to be able to transmit as much electromagnetic signal power as government regulations allow.

An RFID antenna should be relatively inexpensive to produce, practical to handle and ship, and be simple to install. Additionally, the antenna should be unobtrusive when installed and, ideally, easily concealed.

SUMMARY OF THE INVENTION

The invention provides a novel RFID antenna structure particularly suited for reading RFID tags at the item level. The antenna is capable of reading such tags in a near zone as they exist in storage, display or as they pass through a control zone such as a door or other portal, whether or not in bulk and/or in random orientation. The antenna of the invention produces radio frequency electric field beams of diverse polarization and direction. This diversity ensures that at least some beam component with a polarization matching that of each RFID tag will illuminate such a tag to ensure that a signal can be generated by the tag and thereby be detected.

In a preferred embodiment, the antenna is an elongated structure producing a near-field radiation that is used to monitor a cylindrical or semi-cylindrical zone. The axis of the antenna is located at or adjacent to the axis of the cylindrical zone to be monitored. By way of example, the antenna can be arranged vertically. In this configuration, the antenna is capable of monitoring nearby shelves, pallets, display cabinets, or doorways, for example.

In the disclosed embodiments, the antenna comprises twin-feed lines extending along an elongated axis and perturbations or radiators spaced along the length of the antenna. The feed lines can comprise a pair of spaced, preferably flat, coplanar conductors, and the radiators can extend as branches or stubs laterally from the feed lines.

In the preferred embodiments, the stubs are skewed with respect to the antenna axis. The skew or angularity of the stubs relative to the axis develops a favorable polarization pattern. The feed line conductors, ideally, are disposed along a serpentine path, centered about the axis that reduces interference with radiation patterns from the stubs by orienting the stubs normal or nearly normal to the feed lines.

The preferred antenna arrangement is characterized by diversity of both electric field polarization and beam direction, and at the same time a relatively uniform signal strength coming from each radiator. This beam diversity enables the antenna to be driven and radiate at a high power level, without violating Federal Communication Commission (FCC) rules, to ensure RFID tag illumination and, therefore, reliable tag reading. The beam diversity of direction and polarization obtained by the preferred antenna construction, additionally, enhances performance by ensuring that an RFID tag in the antenna operating range with any orientation will be illuminated with an aligned polarized beam. Beam diversity is further increased by using multiple antennas to cover the same zone.

The skewed polarization and beam separation characteristic of the preferred antenna enables an identical antenna or antennas to be flipped on its axis and/or inverted relative to a first antenna to further increase the beam diversity in both polarization and direction.

In the preferred embodiment, the beam diversity is obtained in a counter-intuitive manner by scanning the beams of signal components polarized in the vertical or axial direction of the antenna while the signal components polarized in directions perpendicular to the antenna axis radiate in beams nearly perpendicular to the antenna axis.

DESCRIPTION OF THE PREFERRED EMBODIMENT

Figure 1:
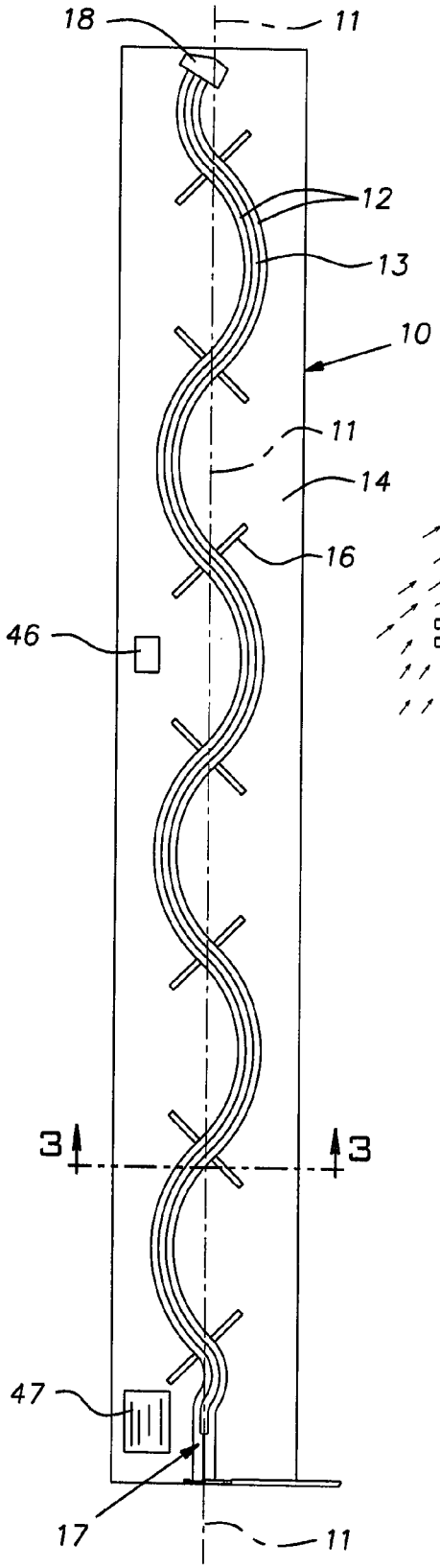
FIG. 1 is an elevational view, in a mid-plane, of a preferred embodiment of an antenna of the invention.

FIG. 1 illustrates a preferred form of an RFID antenna 10. The antenna is elongated along a longitudinal axis 11. The antenna 10 includes a pair of coplanar twin ribbon-like conductors or strips 12 having a gap or space 13 therebetween. The conductors 12, also referred to herein as feed lines, are made of copper or aluminum, for example, and can be relatively thin self-supporting foil or can be printed, deposited, or otherwise fabricated on a thin carrier film 14 of suitable dielectric material such as Mylar®, or etched from a printed circuit board.

Preferably at uniformly spaced locations along the length of the antenna 10 are pairs of stubs (i.e. dipoles) or branch radiators 16, each stub of a pair being in electrical continuity with an associated one of the conductors or feed lines 12. The stubs 16 are conveniently formed conductors such as the same material used for the feed lines 12, are coplanar with the feed lines, and are integrally formed with these lines so as to ensure electrical continuity with these lines.

In one antenna design intended for use to monitor space within a room, the antenna has a nominal length of about 7' and the antenna is used with its axis 11 upright or vertical. The conductors 12 are each about ½" wide and the space or gap 13 between them is about ⅛". The stubs 16 conductor width is used to adjust the radiator's bandwidth. For typical applications the stubs are somewhat narrower than the feed lines and their lengths can be varied from about 2" at a feed end of the antenna 10 to about 3" at the terminal end. In a 7' antenna length seven pairs or dipoles of stubs 16 are used with a spacing of about 12" measured along the axis 11 of the antenna. The distance from a feed or feed matching section 17 described below, to the first pair of stubs 16 is about 4" measured along the center of the gap 13 and the distance from the last pair of stubs 16 can be about 2" from a short 18 between the conductors 12 forming the termination of the antenna. Alternatively, the termination can be an open circuit or an impedance load. Note that the impedance termination can also create radiation, which can be used to excite RFID tags.

Figure 3:
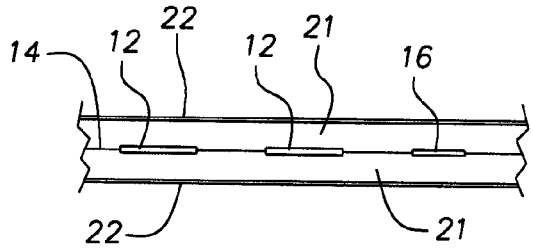
FIG. 3 is a fragmentary cross-section of the antenna taken at the plane 3-3 in FIG. 1.

FIG. 3 is a cross-sectional view of the antenna 10 illustrating a sandwich-like construction. The conductors 12 and the stubs 16 are printed, laminated, or otherwise disposed on the carrier film 14 between two low density dielectric boards or panels 21. Alternatively, the conductors 12 and stubs 16, if sufficiently self-supporting, can be laminated directly to one of the boards 21 so as to eliminate the film 14. As another alternative, the conductors 12 and stubs 16 can be printed directly on a board 21. The boards 21 can be extruded low-density, (1.5 lbs/ft$^3$) polystyrene foam for instance. Protective heavy plastic film 22, for example 0.040" thick, is held firmly or bonded on the exterior surfaces of the foam boards 21. The boards 21, conductive strips 12, stubs 16, any film 14, and film 22 can be solidly held and/or bonded by suitable adhesives together to produce a relatively rigid antenna package, if desired. The presence of the boards 21 ensures that surrounding structures, materials or goods are not so close to the antenna 10 when it is installed as to significantly adversely affect the performance of the antenna.

The stubs or radiators 16, have an orientation that is skewed at an angle to the axis 11 of the antenna. Ideally, the stubs 16 lie at an angle of about 45° with respect to the axis 11. The two stubs or branches 16 forming a dipole at each location along the length of the antenna 10 are preferably in alignment such that both lie along a common line.

Figure 5:
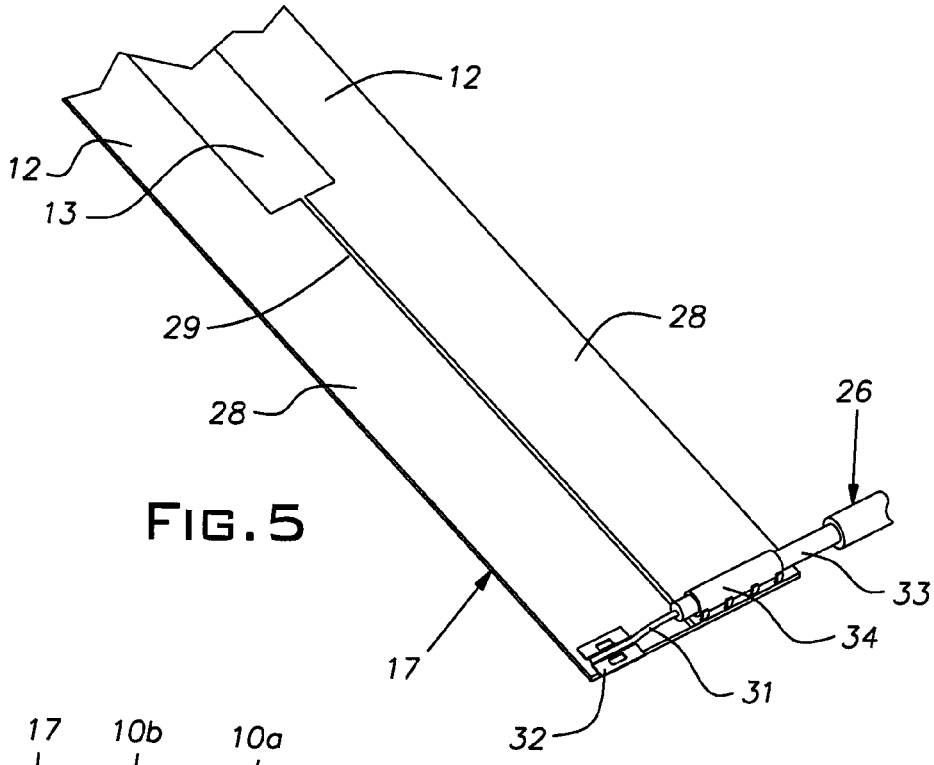
FIG. 5 is an illustration of the feed or input end of the antenna.

FIG. 5 shows a manner of feeding the antenna 10 from a coax cable 26. A feed matching section 17, in the form of a quarter wavelength impedance transformer, includes two conductive strips 28 on a suitable thin non-conductive substrate such as the Mylar® sheet 14 on which the antenna feed lines 12 are carried. The strips 28 are electrically connected to the feed line conductors 12 and are separated by a narrow gap 29 of about 1 mm. A center conductor 31 of the coax cable 26 is electrically connected to one of the strips 28 such as by a mechanical connector in the form of a metal clamp 32 with integral barbs that, after piercing the respective strip, are crimped tightly against the underside of the film 14 carrying the strip or if the strip is self-supporting, against the opposite side of the strip. An outer conductor 33 of the coax cable 26 is similarly electrically connected to the other strip 28 by an associated metal clamp or connector 34. The metal clamps or connectors 32, 34, may be soldered between their respective conductors 31, 33 and feed strips 28, to assure a reliable electrical connection between these elements. Because of the stepped nature of the quarter wavelength impedance transformer, it tends to radiate a small signal level as well. Even this small radiation can be useful for RFID applications as discussed here.

Inspection of FIG. 1 shows that pairs of stubs or branches 16 alternate from a positive slope (the first, third, fifth, and seventh stub pairs) to a negative slope (the second, fourth, and sixth stub pairs). The feed lines 12 act as a two-wire transmission line, from which it is well known that the current on one feed line is out of phase by 180° to the current in the other feed line. This allows the currents in each pair of the stubs 16 to be in phase and, therefore, produce radiated signals that reinforce one another. The short between the feed lines 12 at the terminal end 18 is about a ¼ wavelength or less from the last pair of stubs 16.

The serpentine path of the feed lines 12 has been found to advantageously limit the influence these lines would otherwise generally have on the directional character and strength of the radiated signals produced by the stubs 16. The serpentine configuration of the feed lines 12 serves to space the distal or free ends of the stubs 16 from the feed lines and produces the ideal electric field patterns shown in FIG. 2.

Figure 4:
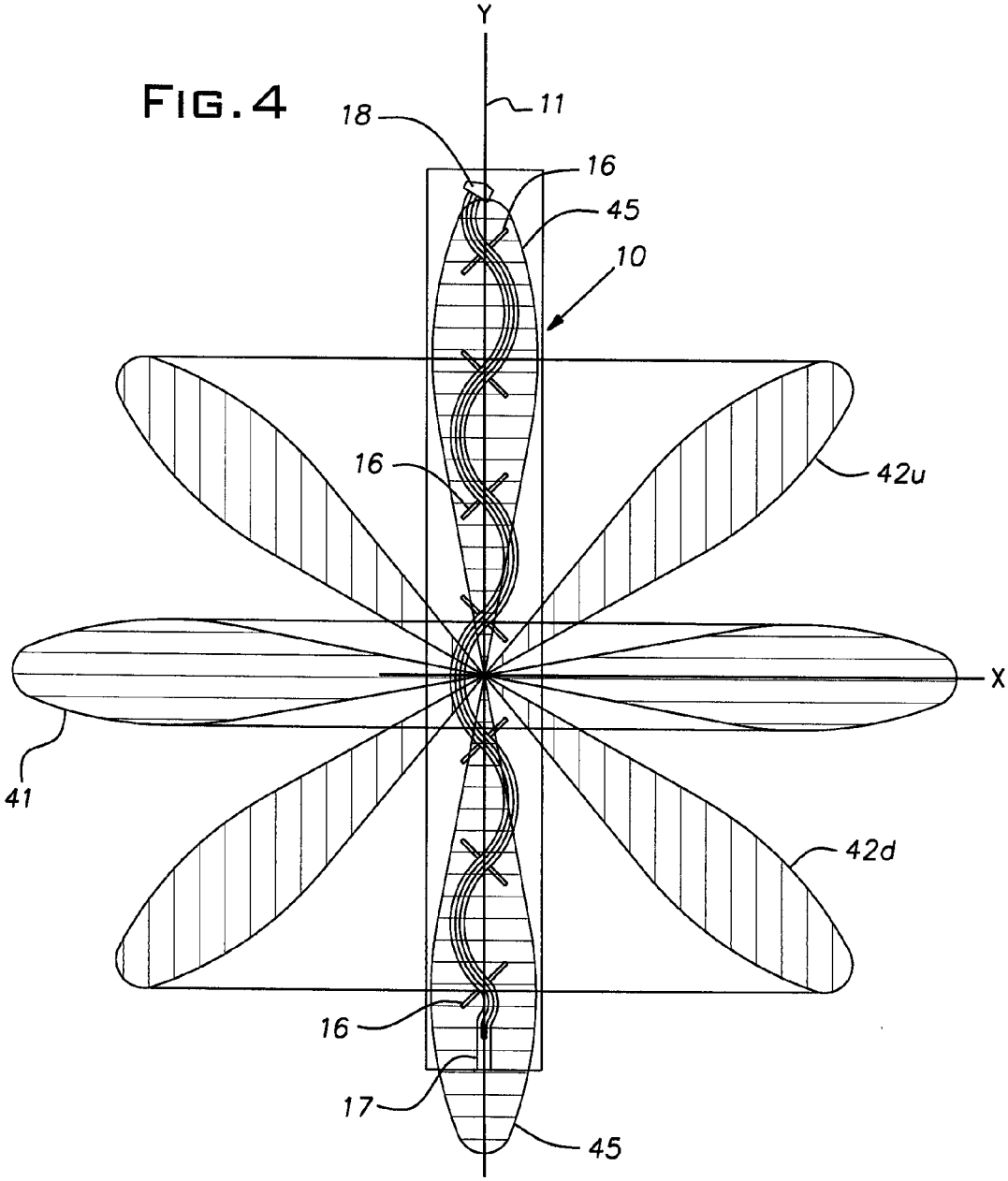
FIG. 4 is a schematic diagram of horizontally and vertically polarized beams radiated from the antenna.

Radiation from a stub 16 is polarized parallel or nearly parallel to the stub. In FIGS. 1 and 4, the stubs, i.e. dipoles 16 are arranged at an angle of +45° or −45° to the axis 11. Radiation of the angled stubs 16 has both horizontal and vertical components in the sense that the axis 11 of the antenna 10 is vertically oriented. The horizontally polarized radiation components of all of the stubs 16 of the antenna 10 are all polarized in the same direction and roughly in-phase such that they create radiation beams 41 that are nearly perpendicular to the antenna axis 11. In addition, horizontally polarized beams 45 are end fire beams produced as a consequence of the nearly full wavelength spacing between the stubs or radiators 16. On the other hand, the vertically polarized radiation components of adjacent stubs 16 are in opposite directions and therefore oppose one another. The interaction of these opposing vertically polarized radiation components produces scanned conical beams tilted off the plane perpendicular to the axis 11 by about ±40°, the angle depending in part on the proximity of the stubs 16 to one another. This phenomenon is schematically depicted in FIG. 4 where horizontally polarized signal components travel in beams 41 nearly perpendicular to the antenna axis 11 and in the end fire direction; whereas, the vertically polarized signal components are radiated in terms of tilted conical beams 42*u* and 42*d*. Because of the complex phasing action between all the stubs and termination, these beams will not all be excited to the same radiation level. Thus, FIG. 4 is an over-simplification and in-use of the antenna the RFID tagged items are illuminated in the near zone of the antenna. FIG. 4 is depicting the horizontally and vertically polarized radiation beams as seen in the far field of the antenna.

From this analysis, it will be understood that the antenna 10 is characterized by a high degree of radiation diversity in the near zone where it operates. The antenna 10 affords both vertically and horizontally polarized signal components, and these signal components are directed in widely divergent beam paths. This diversity reduces the risk of signal fading in areas of the space or zone the antenna 10 is intended to illuminate or survey. Further, the separation of the vertically and horizontally polarized beams 41, 42, 45 allows the antenna to be efficiently driven with a maximum wattage without violating FCC regulations because the power is not concentrated in a single beam, thus providing an effective and inexpensive antenna unit composed of multiple radiators. References to vertical and horizontal orientation throughout this disclosure are for convenience in the explanation, but it will be understood that the antenna 10 can be used in any orientation and the planes of polarization and beam direction will be similarly reoriented.

Figure 6:
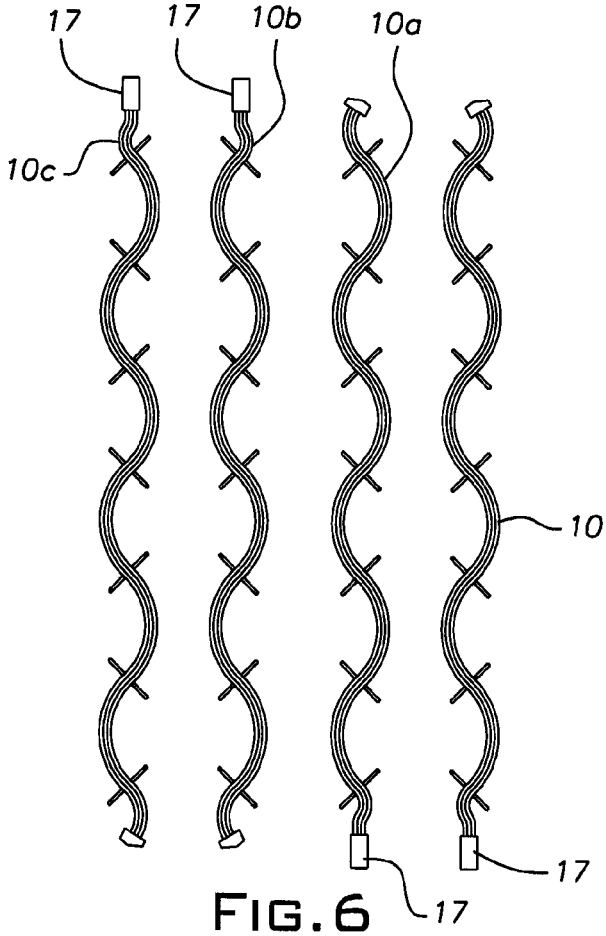
FIG. 6 illustrates the use of adjacent identical antennas with different orientations.

The 45° degree angle of the stubs 16 to the longitudinal axis 11 is of great benefit because it allows a duplicate antenna to be flipped over 180° about its axis relative to a first antenna and produce radiation polarization in planes that are orthogonal to the polarization planes of the first antenna. This arrangement, which significantly improves the signal polarization and beam diversity, is shown by the side-by-side placement of the antenna 10 and the antenna 10*a* in FIG. 6. For even greater radiation diversity, antenna 10*b* can be inverted and for still further diversity, a fourth duplicate antenna 10*c* can be flipped on its axis and inverted adjacent to the antenna 10. Any combination of two or more of the antenna orientations depicted in FIG. 6 can be used. For greatest effectiveness, each of the provided antennas 10, 10*a*, 10*b*, and/or 10*c*, where more than one is used, is operated alone in a sequence with the other(s).

An RFID tag 46 is preferably permanently attached to the antenna 10 and is unique to the particular antenna to which it is attached. Still further, a non-RF machine readable tag 47, again unique to the particular antenna, like an optically readable UPC label or a magnetically encoded tag is also preferably attached to the antenna 10. When the antenna is installed, a technician can scan the non-RF tag 47 and thereby electronically record its location and RFID tag identity at the installation site. At any time thereafter, a reader system can test a particular antenna (with its identity and location previously stored in an electronic memory) by driving it and determining if it senses its own RFID tag.

Figure 7:
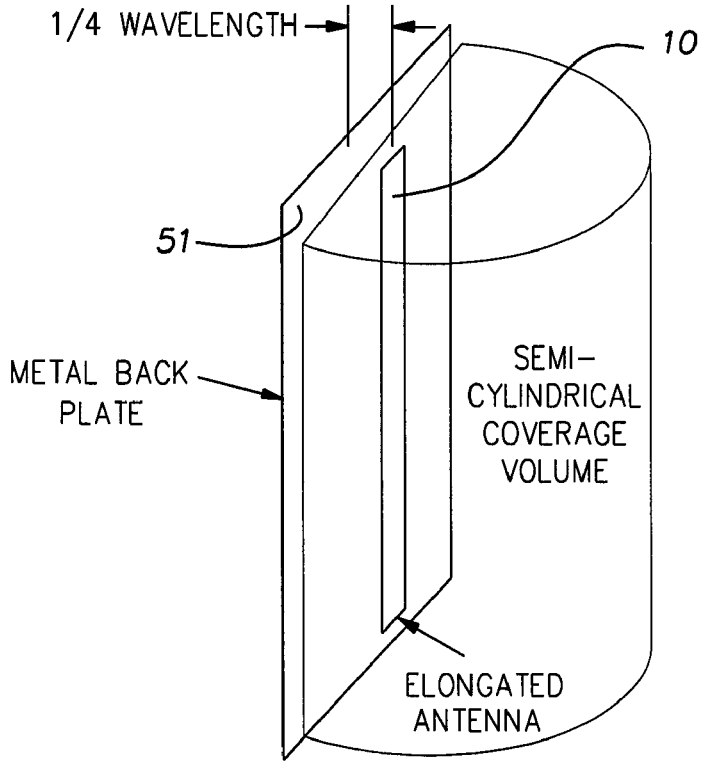
FIG. 7 illustrates an arrangement useful for covering a semi-cylindrical zone on one side of the antenna.

FIG. 7 diagrammatically illustrates an antenna 10 arranged to monitor a semi-cylindrical zone. As shown, a conducting metal plate 51 is spaced some distance (which is normally close to one-quarter wavelength) behind the vertical antenna 10. Reflection from the conducting plate 51 reinforces the forward radiation while blocking back radiation. It will be appreciated that rather than a single antenna, multiple antennas such as arranged in FIG. 6 can be used in the installation depicted in FIG. 7.

Figure 2:
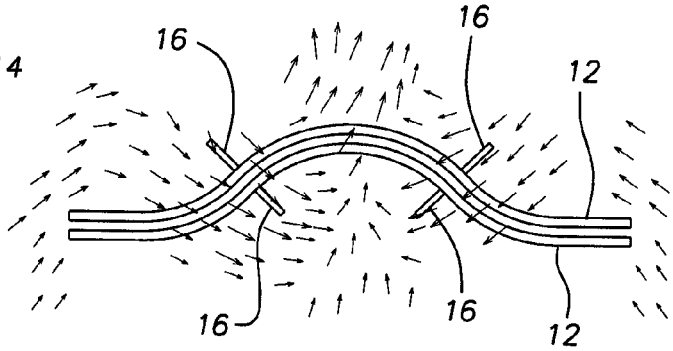
FIG. 2 is a fragmentary enlarged view of the antenna of FIG. 1 showing near zone electric fields.
Figure 8:
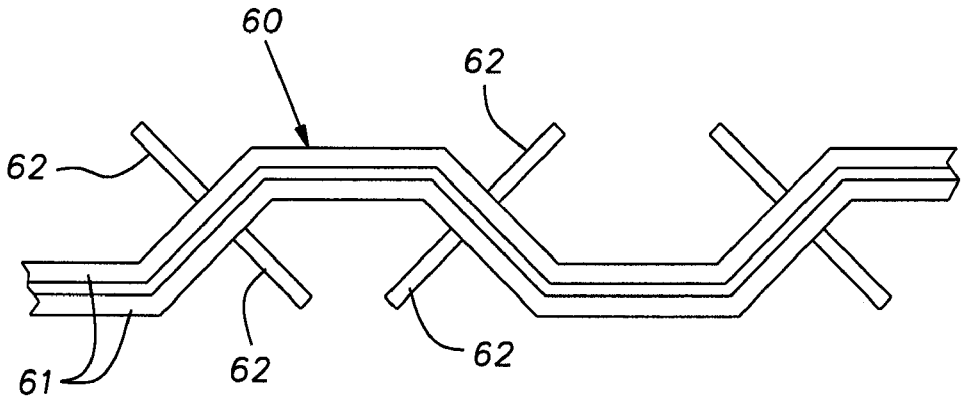
FIG. 8 is an alternative antenna construction.

In FIGS. 8-11, antenna constructions can employ ribbon-like feed lines and radiation areas like those described in connection with FIGS. 1-3 and can be mounted and protected in the same way. FIG. 8 is a fragmentary view of a portion of an antenna 60 with parallel feed lines 61 segments and dual stub radiators 62. The antenna 60 obtains a desired 45° polarization although the abrupt bends in the feed lines 61 may also radiate energy.

Figure 9:
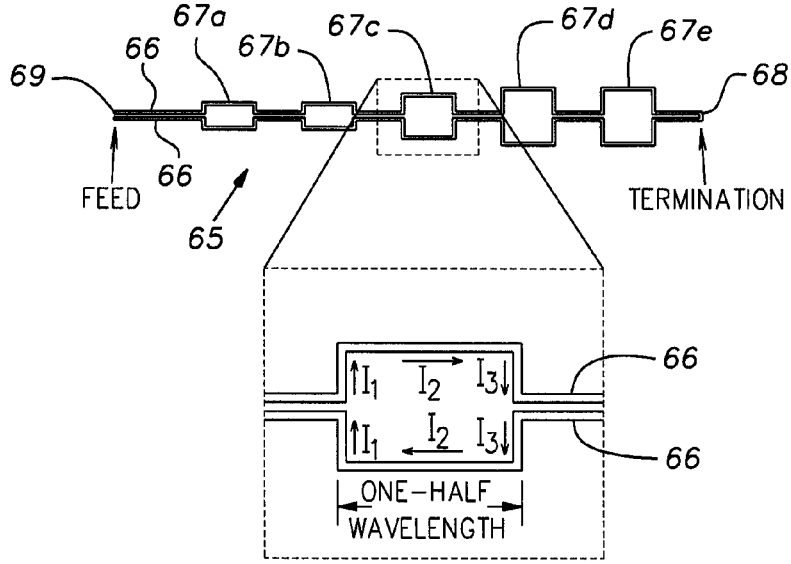
FIG. 9 is a second alternative antenna construction.

Referring now to FIG. 9, there is shown an embodiment of an antenna 65 wherein coplanar strip feed lines or conductors 66 are arranged to cause radiation from the half wavelength sections 67*a-e*. As shown in FIG. 9, the rectangular radiators 67*a-e* are wider near a termination end 68 as compared to the feed end 69. The spacing between the feed lines 66 changes abruptly for roughly a half wavelength section and then changes back to the original spacing. The currents in the feed lines behave similarly to a loop or patch antenna. Currents travel in opposite directions in the two coplanar feed lines 66. Therefore, the currents $I_1$, $I_2$, and $I_3$, have the directions shown in FIG. 9 in each feed line or strip 66. The fields radiated by the currents $I_2$ flowing in opposite directions in the two parallel lines 66 will tend to cancel. The field of currents $I_1$ flowing in the two collinear lines or strips 66 will not cancel each other because they are in phase and flowing in the same direction. The same is true for $I_3$. The fields of currents $I_1$ and $I_3$ do not cancel each other because there is a 180° phase shift due to the half wavelength spacing along the feed line. This gives the antenna 65 a strong polarization component normal to the axis of the feed lines 66. The antenna 65 does not have the 45° polarization of the earlier disclosed embodiments but represents an antenna design using the basic configuration of coplanar strip feed lines.

Figure 10:
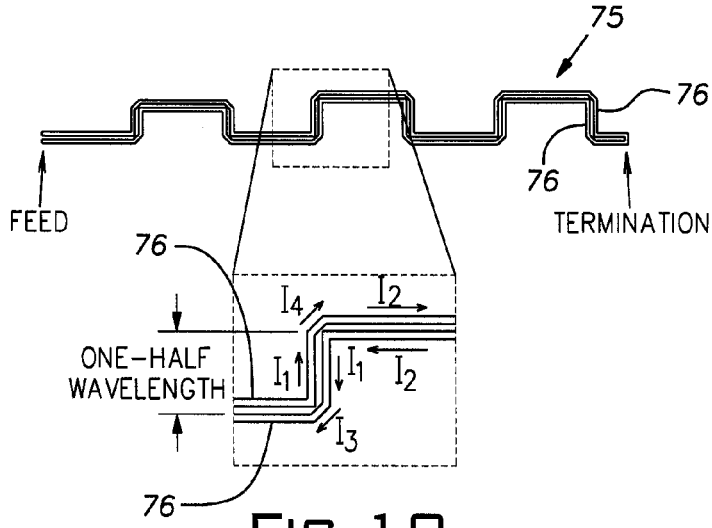
FIG. 10 is a third alternative antenna construction.
Figure 11:
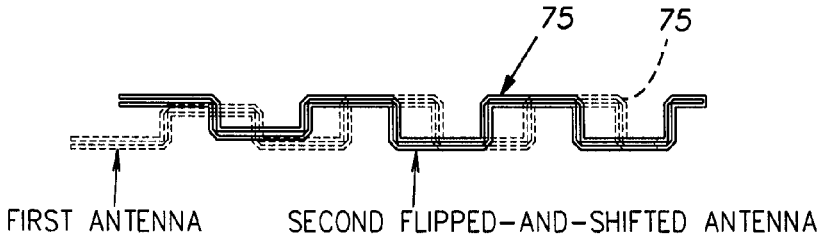
FIG. 11 shows use of two of the antennas of the type shown in FIG. 10.

Referring now to FIG. 10, an antenna 75 having dual feed lines 76, produces radiation from bends in the feed lines. The fields radiated by currents $I_1$ in the two parallel strips will cancel because they are equal and opposite, as will the currents $I_2$. However, the fields radiated by currents $I_3$ and $I_4$ will not cancel each other because of the 180° phase shift due to the half wavelength separation along the feed line. The radiation from $I_3$ and $I_4$ has the desired 45° polarization. The power radiated by $I_3$ and $I_4$ may be controlled by reducing the offset distance to less than a half wavelength. As the currents get closer together their radiated fields will tend to cancel each other. Another way to control the radiation level at a junction is to vary the bend angle. The bend angle shown in FIG. 10 is 90°. If the angle is reduced, such as the 45° angle shown in FIG. 8, the radiation will be reduced relative to that radiated by a 90° bend.

Because of the ±45° polarization of the alternating bend embodiment of FIG. 10, it is possible to combine this antenna 75 with a second identical antenna flipped 180° about its axis. The second antenna 75 will provide orthogonal polarization and may be mounted relatively close to the first antennas shown in FIG. 11. This concept is shown for antenna 75, but it could be used for antenna 10 or 60 as well. Here, the second antenna is shown directly over the first antenna, and can even be shifted one-half period along the axis. For antennas 10 and 60, the second antenna could be rotated 180 degrees about its axis to create the orthogonal polarization as well. The two antennas can be separated using a low density dielectric panel or foam, for example, that is thick enough to prevent excessive coupling between the two feed lines. In this manner, two antennas can be easily mounted in the same package with two ports or feeds.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. An RFID antenna comprising an elongated structure existing along an axis that is long compared to a signal wavelength at a RFID design frequency and including twin ribbon-like feed lines of electrically conductive material, the feed lines being in a common plane and being generally uniformly laterally spaced from one another at areas along the antenna length, and a plurality of radiating perturbations associated with the feed lines at a plurality of locations spaced along the feed lines, at each location each feed line having a perturbation.

2. An RFID antenna as set forth in claim 1, wherein said perturbations are stubs in electrical communication with their respective feed line.

3. An RFID antenna as set forth in claim 2, wherein the spacing between stubs is about one wavelength at the RFID design frequency.

4. An RFID antenna as set forth in claim 2, wherein said stubs are disposed at angles with respect to the axis.

5. An RFID antenna as set forth in claim 4, wherein said stubs are disposed at an angle of about 45° with respect to the axis.

6. An RFID antenna as set forth in claim 4, wherein alternate pairs of said stubs have a positive angle with respect to the axis and intervening pairs of stubs have a negative angle with respect to the axis.

7. An RFID antenna as set forth in claim 4, wherein said feed lines follow a serpentine pattern centered on the axis.

8. An RFID antenna as set forth in claim 7, wherein said stubs are located at adjacent points where the feed lines cross the axis.

9. An RFID antenna as set forth in claim 1, wherein said locations are evenly spaced along the length of the feed lines.

10. An RFID antenna as set forth in claim 1, wherein said feed lines are sandwiched between and protected by two low density dielectric panels.

11. An RFID antenna as set forth in claim 10, wherein said feed lines are carried on a thin dielectric film disposed between said panels.

12. An RFID antenna as set forth in claim 1, wherein said perturbations are bends in the feed lines arranged to produce antenna radiation.

13. An RFID antenna as set forth in claim 12, wherein the bends produce offsets of the feed lines from the axis distributed along the length of the antenna, the offsets being larger with distance from a feed to improve the uniformity of radiation along the length of the antenna.

14. An RFID antenna as set forth in claim 1, wherein said perturbations are changes in the spacing between the feed lines arranged to produce antenna radiation.

15. An RFID antenna as set forth in claim 14, wherein the spacing changes increase with distance from a feed to improve the uniformity of radiation along the length of the antenna.

16. An RFID antenna as set forth in claim 1, including an RFID tag permanently attached to the antenna and having a unique identity associated with the antenna.

17. An RFID antenna as set forth in claim 16, including a non-RF machine readable unique code attached to and uniquely identifying the specific antenna.

18. An RFID antenna as set forth in claim 1, wherein the feed lines are fed by a coax cable having a center conductor and an outer conductor, each of said coax conductors being electrically attached to a side of a flat conductor associated with a respective one of the feed lines by a metal clamp with barbs used to pierce the flat conductor and tightly crimped towards an opposite side of the flat conductor.

19. An RFID antenna as set forth in claim 18, wherein the metal clamps are soldered between their respective coax conductor and flat conductor to assure a reliable connection between these elements.

20. An RFID antenna comprising a pair of twin feed lines extending along an axis, the feed lines comprising flat ribbon-like electrical conductors with a uniform gap size, the feed lines having a serpentine configuration crossing back and forth across the axis, a plurality of radiation stubs associated with the feed lines, the stubs being arranged in collinear pairs, each stub of a pair being associated with a single one of the feed lines, each stub pair extending at an angle to the axis from the feed line adjacent where the feed line crosses the axis, the length of the feed lines between consecutive pairs of stubs is about equal to a wavelength of the RFID frequency.

21. An RFID antenna as set forth in claim 20, wherein the stubs, where they are proximal to the feed lines, lie at generally right angles to their respective feed lines.

22. An RFID antenna as set forth in claim 21, wherein the stubs lie at angles of about 45° to the axis.

23. An RFID antenna as set forth in claim 22, wherein alternate pairs of the stubs have a positive angle to the axis and intervening pairs of stubs have a negative angle to the axis.

24. An RFID antenna as set forth in claim 23, wherein the feed line serpentine configuration is curvilinear.

25. An RFID antenna as set forth in claim 20, wherein said feed lines and stubs are coplanar.

26. An RFID antenna as set forth in claim 20, including an RFID tag attached to the antenna and encoded with data unique to the antenna.

27. An RFID antenna as set forth in claim 20, wherein the feed lines are fed by a coax cable having a center conductor and an outer conductor, each of said coax conductors being electrically attached to a side of a flat conductor associated with a respective one of the feed lines by a metal clamp with barbs used to pierce the flat conductor and tightly crimped towards an opposite side of the flat conductor.

28. An RFID antenna as set forth in claim 27, wherein the metal clamps are soldered between their respective coax conductor and flat conductor to assure a reliable connection between these elements.

* * * * *